United States Patent [19]

Woelfel

[11] Patent Number: 4,525,965

[45] Date of Patent: Jul. 2, 1985

[54] PREFABRICATED BUILDING PANELS

[75] Inventor: John Woelfel, El Paso, Tex.

[73] Assignee: Artcraft Panels, Inc., Vinton, Tex.

[21] Appl. No.: 347,567

[22] Filed: Feb. 10, 1982

[51] Int. Cl.[3] ..... E04B 7/00; E04C 2/26

[52] U.S. Cl. ..... 52/309.17; 428/446

[58] Field of Search ..... 52/309.12, 309.17, 741, 52/743; 428/446; 156/71

[56] References Cited

U.S. PATENT DOCUMENTS

| | | | |
|---|---|---|---|
| 3,327,442 | 6/1967 | Hermann | 52/309 |
| 3,666,606 | 5/1972 | Stokes | 161/37 |
| 4,263,372 | 4/1981 | Emmons et al. | 52/309.17 X |
| 4,288,956 | 9/1981 | Heck | 52/309.12 |
| 4,327,536 | 5/1982 | Ascher | 52/309.12 |
| 4,349,398 | 9/1982 | Kearns et al. | 52/309.12 X |
| 4,364,213 | 12/1982 | Biesanz | 52/309.17 |

OTHER PUBLICATIONS

Gail International Corp. Brochure entitled, "Prefabricated Brickplate Panels for Highrise Exteriors".

*Primary Examiner*—J. Karl Bell

*Attorney, Agent, or Firm*—Arnold, White & Durkee

[57] ABSTRACT

Prefabricated building panels and methods for their manufacture is provided wherein the panels comprise a frame support structure, in one embodiment, a sheathing layer attached thereto, and a means for bonding a modified concrete matrix onto the support frame, the matrix including in its uncured state: Aggregate, cement, water, sand, an acrylic emulsion, an anti-foramer and a plasticizer. The matrix is then smoothed and textured to become the outer facing of the panel, or a facing layer is bonded onto the matrix. Alternatively, a cushioning material is bonded onto matrix and covered with a bonding agent into which a facing layer is embedded.

13 Claims, 2 Drawing Figures

Fig. 1
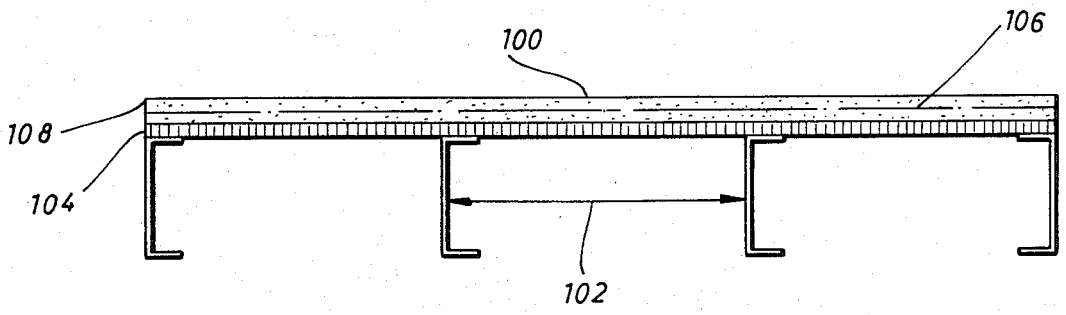
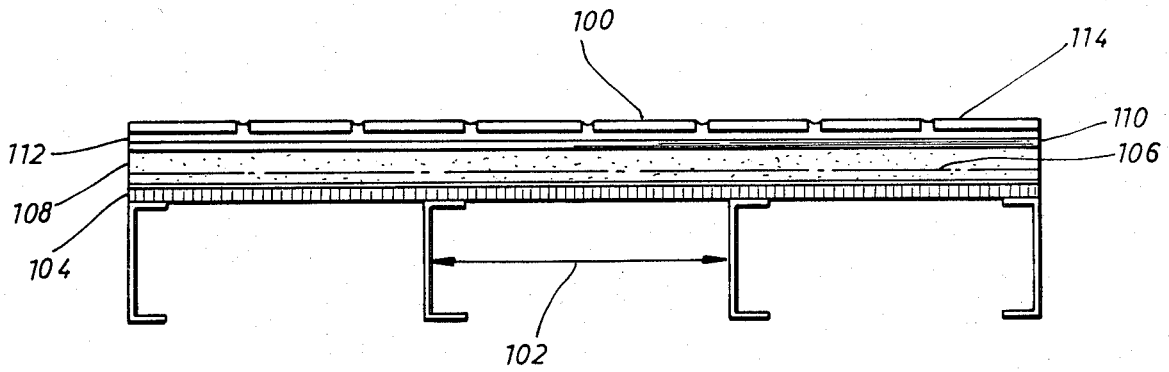
Fig. 2

PREFABRICATED BUILDING PANELS

BACKGROUND OF THE INVENTION

1. Field of the Invention

The present invention relates to unique prefabricated cated building panels and to methods for their manufacture.

2. Description of the Background

In the past, prefabricated building panels have been manufactured by mounting rigid board material onto a frame and applying the facing material to the board with a bonding agent.

Another prior method mounted the rigid board to the frame, stapled a waterproof material to the board, secured a metal lath to the board and frame and applied several coats of Portland cement plaster. Prior methods included the addition of styrene-butadiene rubber and fiberglass strands to the cement. Finally, ridge-backed tile was beaten into the thin set cement and allowed to set.

Tile failure has been a problem with prior types of panels. Expansion and contraction due to changing weather conditions, and movement due to earth tremors and quakes, wind, shifting and settling of the building, sonic booms, freezing in the presence of moisture and the like may stress the support structure for the building's facing sufficiently to bend and separate the support structure from the rest of the panel causing the facing to crack or disbond. The unique strength and flexibility of the building panels disclosed in the present invention allows greater stress to be placed on the panel while maintaining deflection of the support frame and differential movement between the frame and the rest of the panel within tolerable limits, thereby lessening the possibility of cracking and disbonding of the facing material.

U.S. Pat. No. 3,666,606 to Stokes disclosed a manufactured composite membrane sheet without a support structure which was adhesively bonded directly onto an architectural substrate. The system was used for outdoor and indoor tile flooring as well as for indoor walls. The system comprised a rubber elastomeric layer, such as polychloroprene rubber, bonded to a sheet of synthetic polymer resin including a plasticizer, a stabilizer and a synthetic resin fiber scrim embedded therein.

The use of an elastomeric layer to isolate tile from substrate movement improves the art by lessening the possibility of impairment of the membrane and tile system. However, in application of facing material to multistoried buildings greater strength of the paneling system must be achieved. It would be desirable to develop a prefabricated building panel which incorporated both superior strength and cushioning effect. This unique and useful product and method is provided with the present invention.

SUMMARY OF THE INVENTION

In accordance with the present invention, a prefabricated building panel is provided comprising a support frame having an upper surface. A layer of sheathing material covers the upper surface of the frame and is attached to the frame. A means for bonding a modified concrete matrix to the frame is attached to the frame. The modified concrete matrix, includes additives to increase self-curing properties, strength and flexibility, and decrease air content in the matrix.

In a presently preferred embodiment, the bonding means is a wire mesh attached to the support frame and which is covered by and embedded into the concrete matrix. The cement matrix can be textured and the matrix itself becomes the facing of the tile panel, or alternatively, a facing layer can be bonded onto the matrix.

In an alternative embodiment, a bonding means such as wire mesh is attached to the outer surface of a support frame. A layer of modified concrete matrix is spread on a surface and the outer surface of the support frame covered with the wire mesh is embedded into the matrix.

In a presently preferred embodiment of the present invention the support frame is a steel stud support frame. The modified concrete matrix is comprised of aggregates, cement, water and sand as well as an acrylic emulsion, an anti-foamer and a plasticizer.

Alternatively, the matrix is covered with a layer of cushioning material which is attached to the matrix. The cushioning material is covered with a bonding agent into which a facing layer is embedded.

In a presently preferred embodiment, the cushioning material is liquid polyurethane rubber, the bonding agent is an epoxy polyamide and the facing layer is tile, granite or aggregate.

In accordance with the present invention, a method of manufacturing a prefabricated building panel is also provided. The method comprises a support frame, attaching a means for bonding a modified concrete matrix to the frame, the modified concrete matrix including additives to aid self-curing properties, strength and flexibility, and decrease air content of the matrix, curing the matrix and grinding it until it is smooth.

Alternatively, the method comprises the initial steps of covering the outer surface of a support frame with sheathing material and attaching the sheathing material to the support frame.

The resulting outer surface of the concrete matrix is then textured to provide the facing for the panel. This texturing is achieved by sandblasting, grinding, grooving or the like. Alternatively, the method further includes bonding to the concrete matrix a layer of cushioning material, covering the cushioning material with a bonding agent and embedding a facing layer in the bonding agent.

BRIEF DESCRIPTION OF THE DRAWINGS

In the accompanying drawings wherein like numerals designate like parts in the figures:

FIG. 1 is an enlarged fragmentary cross-sectional view of a prefabricated building panel in accordance with the present invention with the sandblasted concrete matrix as the facing material.

FIG. 2 is an enlarged fragmentary cross-sectional view of a prefabricated building panel in accordance with the present invention with tile as the facing material.

It will be appreciated that the present invention can take many forms and embodiments. Some embodiments of the invention are described so as to give an understanding of the invention. It is not intended that the illustrative embodiments described herein should limit the invention.

DESCRIPTION OF SPECIFIC EMBODIMENTS

Referring to FIG. 1, there is illustrated a cross-sectional view of an embodiment of prefabricated building panel 100. Panel 100 comprises support frame 102. Attached to support frame 102 is a layer of sheathing material 104. Also attached to support frame 102 through the sheathing material is bonding means, such as wire mesh 106. Covering wire 106 and embedding therein is a modified concrete matrix 108.

In an alternative embodiment sheathing material 104 is eliminated. Bonding means such as wire mesh 106 is attached to the outer surface of support frame 102. Modified concrete matrix 108 is spread out on a preferably level surface. The outer surface of support frame 102 within bonding means attached is embedded in modified concrete matrix 108.

In a preferred embodiment of the present invention, support frame 102 is a welded rigid metal stud framework. The rigid metal frame is constructed of 12 to 20 gauge steel in the preferred embodiment, and most preferably of 16 gauge steel. The studs are placed 12 inches to 24 inches on center. The sheathing material, if used, is preferably gypsum board but can be cement asbestos board, foam board or any rigid board material. The thickness range of the sheathing material is $\frac{1}{4}$ inch to 1 inch, preferably $\frac{1}{2}$ to $\frac{5}{8}$ inch. The wire mesh is preferably 1 inch by 1 inch, 1 inch by 2 inches, 2 inches by 2 inches, or factions thereof, galvanized wire mesh, constructed of 10 to 18 gauge, preferably 16 gauge, metal wire.

Typically, the initial, uncured composition of the modified concrete matrix of the present invention has the following range of compositions:

| Component | Amount (Percent by Weight) Broad Range | Preferred Range |
|---|---|---|
| Aggregate | 40–45% | 42–43% |
| Cement | 15–20% | 17–19% |
| Water | 1–6% | 2–5% |
| Acrylic Emulsion | 1–10% | 3–5% |
| Sand | 30–35% | 32–34% |
| Antifoamer | .05–.15% | .08–.12% |
| Plasticizer | .05–.15% | .08–.12% |

Because of its superior strength, Portland cement is preferred among the hydraulic cements for use in the above composition. The term "Portland cement" as used herein includes those materials as normally understood in the art.

The additive of concrete matrix 108 which increases strength and adds self-curing properties is preferably an acrylic emulsion. The acrylic emulsion is preferably an emulsion polymerization of methyl and butyl esters of methyl acrylic acid such as that available from Rohm & Haas Co. under the trade name "Rhoplex MC-76."

The additive of concrete matrix 108 which improves workability is preferably a plasticizer which is compatible with the self-curing additive being used and more preferably an anionic naphthalene.

The additive of modified concrete matrix 108 which prevents or reduces air content in the matrix, thereby increasing the strength of the concrete is preferably an alkyl silane defoamer such as that available from Dow Chemical under the trade name "Antifoam B."

It should be understood that the present invention encompasses the use of other additives in the concrete matrix which add self-curing properties, increase strength, improve flexibility and decrease air content of the matrix.

In one embodiment of the present invention, the modified concrete matrix 108 forms the facing layer of the prefabricated tile panel. The large (preferably $\frac{3}{8}$ inch) aggregates and the fine sand may be colored to suit architectural taste. Matrix 108 is smoothed to remove inperfections and produce a substantially smooth exposed surface. Optionally, this substantially smooth exposed surface may be textured by any convenient means, such as sandblasting, grinding, ribbing and the like, to form the outer facing of panel 100.

In another embodiment of the present invention, a facing layer is bonded directly onto the concrete matrix using any suitable bonding material.

Alternatively, if other forms of facing are to be used, panel 100, as shown in FIG. 2, further comprises a layer of cushioning material 110 covering and bonded to modified concrete matrix 108, a bonding agent 112 covering cushioning material 110 and a facing layer 114 embedded in bonding agent 112.

In the preferred embodiment of the present in invention, cushioning material 110 is a liquid synthetic rubber. Cushioning material 110 varies in thickness from 10 to 60 mils, preferably being 30 mils thick. The liquid synthetic rubber is preferably a two-component polyurethane rubber. It is understood that any type of cushioning material capable of both preventing moisture penetration and absorbing shock is encompassed by the present invention.

Bonding agent 112 is preferably a two-component epoxy polyamide which results in a flexible bond. The epoxy polyamide available from C. E. Kaiser Co. under the trade name "KB Epoxyment" has been found to produce satisfactory bonding. The layer of bonding agent is preferably 1/16 to $\frac{1}{8}$ inches thick.

In the preferred embodiment of the present invention, facing layer 114 comprises a ceramic or quarry tile, an aggregate, granite or marble slabs or any other type of facing capable of being embedded into bonding agent 112 and providing a durable and attractive finish.

The method for prefabricating building panel 100 comprises the initial step of attaching a means for bonding modified concrete matrix 108 to the outer surface of support frame 102, the bonding means preferably wire mesh 106.

Modified concrete matrix 108 is prepared in a conventional mixer by conventional methods. After mixing, the matrix is spread out on a preferably level surface and the outer surface of support frame 102 with bonding means attached is embedded in the matrix. The preferable thickness of the matrix is one inch. Matrix 108 is partially cured for at least 24 hours. After this partial curing, the matrix is smoothed, preferably by grinders with diamond stone, until it is substantially smooth and peferably to a thickness of $\frac{7}{8}$ inch.

In an alternative embodiment, the method comprises the initial step of attaching sheathing material 104, preferably gypsum board, to support frame 102. Bonding means, preferably wire mesh 106 is then attached through the sheathing material to the frame. The modified concrete matrix 108 is spread atop wire mesh 106 so that the mesh is completely covered and the matrix penetrates the mesh to surround and embed the wire. The panel is vibrated by a vibrator so that the matrix embeds and covers the wire mesh.

In an alternative embodiment of the present invention matrix 108 is textured, as by sandblasting, grinding, ribbing or the like to form the facing layer of the prefabricated building panel.

In another alternative embodiment of the present invention a facing layer is bonded directly onto the concrete matrix using any suitable bonding means.

In the preferred embodiment, matrix 108 is covered with a layer of cushioning material 110 which is bonded to the matrix. This cushioning material is preferably self-bonding, such as a liquid synthetic rubber. If a liquid, self-bonding cushioning material is used, the material is at least partially cured for a period of time from 4 hours to 4 days, preferably for 24 hours. If the cushioning material is not self-bonding, it may be attached to the matrix by any suitable bonding means. Bonding agent 112, as described above, is applied to a uniform thickness of preferably 1/16 to ⅛ inch to cover the cushioning material. Facing layer 114, as previously described, is embedded into bonding agent 112. Such embedding must be performed while bonding agent 112 is still tacky, preferably within no more than two hours, most preferably immediately.

The unique strength and stress cushioning ability of the present invention which greatly decreases the possibility of disbonding and cracking of the facing layer is illustrated in the following examples where tests were performed on applicant's improved panels and on panels constructed by previously known methods.

The steel framing for all of the panels was manufactured from 16 gauge, 6 inch galvanized 50,000 yield wide flange channel stud with one inch welded joints. On panel A, a cement asbestos board was applied with cad plated screws, 16 inches on center. An epoxy polyamide was applied and an aggregate facing layer was embedded into the epoxy.

On panels B, C, D and E, the same steel frame was used. The frame was covered with ½ inch gypsum board sheathing. The sheathing was overlaid with a galvanized steel mesh attached to the frame with cad plated screws, 16 inches on center. The modified concrete matrix was applied, partially cured, ground and smoothed to a thickness of ⅞ inch according to the method of the present invention.

In panel B, tile facing was applied directly to the concrete matrix layer with an epoxy polyamide bonding agent.

In panel C, no other facing was applied. The matrix was sandblasted to produce the facing layer.

In panel D, a 60 mil layer of liquid polyurethane rubber was applied by the applicant's method and at least partially cured to a panel manufactured similar to panel B. Tile was then applied with the epoxy polyamide.

Panel E was manufactured identically to Panel D, with the exception that the polyurethane rubber layer was only 30 mils thick.

All panels were designed to withstand a 50 lb. wind load with a deflection of 0.400 inch. The panels were exposed to positive (inward) pressures of 25, 50, 75 and 100 pounds per square foot, (P.S.F.) and to negative (outward) pressures of 25, 50, 75 and 100 pounds per square foot (P.S.F.). The deflection was measured after each 10 second exposure to the pressure level. The differential movement of the span between the steel studs and the back side of the panel was also measured. The results of these tests are summarized as follows:

| Panel A | | | Panel B | | |
|---|---|---|---|---|---|
| Pressure in P.S.F. | Def in inches | Dif in inches | Pressure in P.S.F. | Def in inches | Dif in inches |
| +25 | .120 | .040 | +25 | .090 | .000 |
| +50 | .295 | .040 | +50 | .200 | .010 |
| +75 | .415 | .030 | +75 | .290 | .010 |
| +100 | .605 | .040 | +100 | .365 | .010 |
| −25 | .150 | .030 | −25 | .075 | .010 |
| −50 | .295 | .030 | −50 | .160 | .030 |
| −75 | .450 | .060 | −75 | .265 | .030 |
| −100 | .570 | .180 | −100 | .400 | .030 |

-continued

| Panel C | | | Panel D | | |
|---|---|---|---|---|---|
| Pressure in P.S.F. | Def in inches | Dif in inches | Pressure in P.S.F. | Def in inches | Dif in inches |
| +25 | .140 | .020 | +25 | .090 | .010 |
| +50 | .300 | .030 | +50 | .215 | .020 |
| +75 | .260 | .040 | +75 | .410 | .040 |
| +100 | .580 | .050 | +100 | .520 | .050 |
| −25 | .140 | .020 | −25 | .085 | .030 |
| −50 | .175 | .030 | −50 | .220 | .060 |
| −75 | .425 | .060 | −75 | .345 | .090 |
| −100 | .500 | .110 | −100 | .570 | .150 |

| Panel E | | |
|---|---|---|
| Pressure in P.S.F. | Def in inches | Dif in inches |
| +25 | .085 | .000 |
| +50 | .210 | .000 |
| +75 | .320 | .000 |
| +100 | .425 | .000 |
| −25 | .075 | .000 |
| −50 | .200 | .020 |
| −75 | .320 | .020 |
| −100 | .600 | .020 |

+ indicates inward pressure;
− indicates outward pressure;
def. indicates defection;
dif. indicates differential movement.

The results of these tests show that in the range of pressures from −75 P.S.F. to +100 P.S.F., the resultant deflection in panels constructed in accordance with the present invention (panels B, C, D and E) was less than that of the panel constructed by previous methods (Panel A) and less than the allowable deflection of 0.400 inch. At pressure levels of +25, +50, and −100, the differential movement exhibited by all of the panels constructed in accordance with the present invention was less than that of the panel constructed by previous methods. Panel E showed an exceptional lack of differential movement and was within the allowable deflection in the range of pressure from −75 P.S.F. to +75 P.S.F.

At a negative pressure of 104 P.S.F. Panel A buckled the steel studs at vertical midspan and the exterior face blew out. At a negative pressure of 130 P.S.F. Panels B and D broke and bulged outward at the vertical midspan area. All tile remained in place.

The foregoing description has been directed to particular embodiments of the invention in accordance with the Patent Statue for purposes of illustration and explanation. It will be apparent, however, to those skilled in this art that many modifications and changes in the prefabricated building panels and methods set forth will be possible without departing from the scope and spirit of the invention. It is intended that the following claims be interpreted to embrace all such modifications and changes.

What is claimed is:

1. A prefabricated building panel comprising:

a rigid metal stud support frame having an outer surface;

a layer of sheathing material covering the outer surface of the frame and attached thereto;

a wire mesh covering the sheathing material and attached to the frame; and a modified concrete matrix bonded to the wire mesh, the matrix comprising by weight in its uncured state: 15–20% hydraulic cement, 2–5% water, 1–10% acrylic emulsion, 0.05–0.15% anti-foamer, 0.05–0.15% plasticizer, 40–45% aggregate and 30–35% sand.

2. A prefabricated building panel as defined in claim 1 further comprising:

a layer of liquid synthetic rubber from 10 to 60 mils in thickness covering the matrix;

a bonding agent affixed to the liquid synthetic rubber; and a facing layer embedded in the bonding agent.

3. A prefabricated building panel comprising:

a support frame having an outer suface;

a bonding means covering and attached to the outer surface of the frame; and a modified concrete matrix including an acrylic emulsion, a plasticizer, and an anti-foamer as additives, the matrix bonded to the bonding means.

4. A prefabricated building panel as defined in claim 3 further comprising a layer of sheathing material covering the outer surface of the frame and attached thereto.

5. A prefabricated building panel as defined in claim 3 wherein the bonding means is wire mesh.

6. A prefabricated building panel as defined in claim 3 wherein the initial, uncured modified concrete matric comprises by weight: 15–20% hydrualic cement, 2–5% water, 1–10% acrylic emulsion, 0.05–0.15% anti-foamer, 0.05–0.15% plasticizer, and the balance sand and aggregate.

7. A prefabricated building panel as defined in claim 3 wherein said initial, uncured, modified concrete matrix comprises by weight: 40–45% aggregate and 30–35% sand.

8. A prefabricated building panel as defined in claim 3 wherein the modified concrete matrix is textured.

9. A prefabricated building panel as defined in claim 3 wherein the support frame is a rigid metal stud support frame.

10. A prefabricated building panel as defined in claim 3 further comprising a facing layer bonded onto the modified concrete matrix.

11. A prefabricated building panel as defined in claim 3 further comprising:

a layer of cushioning material bonded to the modified concrete matrix;

a bonding agent affixed to the cushioning material; and a facing layer embedded in the bonding agent.

12. A prefabricated building panel as defined in claim 11 wherein the cushioning material is liquid synthetic rubber.

13. A prefabricated building panel as defined in claim 11 wherein the bonding agent is an epoxy polyamide.

* * * * *